US005397413A

United States Patent [19]

Trimble et al.

[11] Patent Number: 5,397,413

[45] Date of Patent: Mar. 14, 1995

[54] APPARATUS AND METHOD FOR PRODUCING A WEB OF THERMOPLASTIC FILAMENTS

[75] Inventors: Lloyd E. Trimble, Greenville; Leon M. Zeldin, Greer; William J. Grubbs, Greenville; John V. Francis, Taylors, all of S.C.

[73] Assignee: Fiberweb North America, Inc., Simpsonville, S.C.

[21] Appl. No.: 867,042

[22] Filed: Apr. 10, 1992

[51] Int. Cl.[6] ..... D04H 3/16

[52] U.S. Cl. ..... 156/167; 156/180; 156/181; 156/296; 156/433; 156/441; 156/272.6; 156/273.1; 425/174.8 E; 264/22

[58] Field of Search ..... 156/167, 180, 181, 433, 156/272.6, 273.1, 296, 441; 425/174.8 E; 264/22

[56] References Cited

U.S. PATENT DOCUMENTS

| | | | |
|---|---|---|---|
| 3,163,753 | 12/1964 | Di Sabato et al. . | |
| 3,293,718 | 12/1966 | Sheets . | |
| 3,296,678 | 1/1967 | Bundy et al. . | |
| 3,314,122 | 4/1967 | Bundy . | |
| 3,338,992 | 8/1967 | Kinney . | |
| 3,341,394 | 9/1967 | Kinney . | |
| 3,433,857 | 3/1969 | Dutton et al. . | |
| 3,485,428 | 12/1969 | Jackson . | |
| 3,565,729 | 2/1971 | Hartmann | 156/167 X |
| 3,596,312 | 8/1971 | Ohmatsu . | |
| 3,689,608 | 9/1972 | Hollberg et al. . | |
| 3,967,118 | 6/1976 | Sternberg . | |
| 4,009,508 | 3/1977 | Sternberg . | |
| 4,086,381 | 4/1978 | Cheshire et al. | 156/167 X |
| 4,163,305 | 8/1979 | Semjonow et al. . | |
| 4,208,366 | 6/1980 | Kinney . | |
| 4,208,965 | 6/1980 | Eichler et al. . | |
| 4,233,014 | 11/1980 | Kinney | 425/174.8 E |
| 4,295,178 | 10/1981 | Spengler . | |
| 4,334,340 | 6/1982 | Reba . | |
| 4,380,104 | 4/1983 | Kamioka et al. . | |
| 4,477,263 | 10/1984 | Shaver et al. . | |
| 4,668,448 | 5/1987 | Weber et al. . | |
| 4,753,698 | 6/1988 | Hartmann et al. . | |
| 4,790,736 | 12/1988 | Keuchel . | |
| 4,810,180 | 3/1989 | Isner . | |
| 4,904,174 | 2/1990 | Moosmayer et al. . | |
| 4,908,165 | 3/1990 | Kramer et al. . | |
| 5,122,048 | 6/1992 | Deeds | 425/174.8 E |
| 5,225,018 | 7/1993 | Zeldin et al. | 425/174.8 E |

FOREIGN PATENT DOCUMENTS

| | | | |
|---|---|---|---|
| 0010756 | 5/1980 | European Pat. Off. . | |
| 2309655 | 11/1976 | France . | |
| 2303328 | 7/1973 | Germany . | |
| 59-88961 | 5/1984 | Japan | 264/22 |
| 60-94663 | 5/1985 | Japan | 19/299 |
| 723920 | 2/1955 | United Kingdom | 264/22 |
| WO91/07530 | 5/1991 | WIPO . | |

OTHER PUBLICATIONS

Gilmore, Thomas F., "Spunbond Web Formation Processes: A Critical Review" presented at INSIGHT 90 Conference, Toronto, Oct. 1990.

*Primary Examiner*—Jeff H. Aftergut
*Attorney, Agent, or Firm*—Bell, Seltzer, Park & Gibson

[57] ABSTRACT

A slot draw attenuator apparatus and method are provided for producing webs of spunbonded thermoplastic filaments having improved cover even at low basis weights. The filaments are introduced to a slot draw attenuator having corona electrodes mounted in an elongate insulator bar and staggered and spaced along one wall of the attenuator slot near the exit end thereof. The corona electrodes are electrically connected to a high voltage source. The opposing wall of the slot is grounded. A corona is created in the attenuator slot so that the filaments are charged as they exit the attenuator. The electrostatic charge induces repelling forces in the filaments so that the filaments spread before they are randomly deposited upon a forming belt.

24 Claims, 3 Drawing Sheets

POWER SUPPLY
19
78
76
69
74
72
52
70
54
58
60
66
68

APPARATUS AND METHOD FOR PRODUCING A WEB OF THERMOPLASTIC FILAMENTS

FIELD OF THE INVENTION

The invention relates to an apparatus and method for producing a web of spunbonded thermoplastic filaments, and more particularly relates to an apparatus and method for producing a spunbonded web of enhanced uniformity and quality.

BACKGROUND OF THE INVENTION

The spunbonding process is widely used for producing nonwoven fabrics from thermoplastic filaments. Spunbonded fabrics can be produced by many routes, but the majority of spunbonding processes include the basic steps of extruding continuous filaments of a fiber-forming thermoplastic polymer, quenching the filaments, drawing or attenuating the filaments, usually by a high velocity fluid, and depositing the filaments on a collection surface to form a web.

Manufacturers of spunbonded nonwoven fabrics have long sought to improve the manufacturing process to achieve higher productivity and better quality and uniformity of the spunbonded nonwoven fabric. Maintaining the quality and uniformity of the fabric becomes a particular concern at higher production speeds and when producing fabrics of low basis weight. Several characteristics affect the quality and uniformity of spunbonded nonwoven fabrics.

Filament separation is the degree of separation of the individual filaments from one another. Good filament separation occurs when the filaments are randomly arranged with limited parallel contact between the filaments. Ideally, no individual filaments should be in parallel contact with another filament, although, in practice, filaments tend to be in parallel contact over considerable distances. Good filament separation is particularly important for light weight fabrics, where good coverage is more difficult to achieve. Ropiness is the extreme state of poor filament separation. Large numbers of filaments in parallel twisted contact result in long strands in the fabric, which can causes holes or very thin areas in the fabric. Splotchiness is a relative large-scale non-uniformity in basis weight. A fabric having splotchiness is generally weak because of the lower tensile strength of the thin areas of the fabric. Also, a splotchy fabric generally has poor cover properties.

In the early spunbond processes which used round attenuator tubes to attenuate and draw the filaments, achieving good uniformity and adequate cover presented significant challenges, particularly when manufacturers attempted to produce lighter weight webs or to produce webs at higher speeds or reduced cost. The round attenuator tubes, often called Lurgi tubes, typically use large quantities of high pressure air that provide the attenuation force for the filaments. This results in high utility costs and high noise levels. Increasing the number of filaments in each tube to increase productivity and to reduce the utility expense results in increased problems of poor filament separation, ropiness and webs having poor cover.

Many attempts have been made to overcome the above problems of filament separation, ropiness and splotchiness while still preserving the tensile properties of nonwoven webs made from spunbonded thermoplastic filaments. For example, U.S. Pat. Nos. 3,296,678; 3,485,428 and 4,163,305 describe various apparatus and methods for mechanical and pneumatic oscillation of continuous filament bundles to spread the filaments as they are deposited on the collection surface. U.S. Pat. No. 4,334,340 describes using an air foil at the exit of a round attenuator tube to separate continuous filaments prior to their deposit on a forming wire. Forced air follows the leading edge of the air foil and filaments striking the foil are carried by the forced air onto a forming wire, resulting in a spreading of the filament bundle that promotes random deposit of the filaments.

Various electrostatic methods have been proposed to promote spreading of the filament bundle by applying an electric charge to the filaments to cause the filaments to repel one another. U.S. Pat. No. 3,338,992 describes triboelectric charging, in which the filaments are charged by rubbing contact with a suitable dielectric material and repelling forces induced in the filament bundle cause the filaments to separate as they exit a forwarding gun and prior to deposit on the forming wire. However, rubbing contact typically is not desirable for more delicate webs, and this method is also subject to lack of reliability when ambient conditions change. The above-noted U.S. Pat. Nos. 3,338,992 and 3,296,678 also describe electrostatically charging the filament bundle with an ion gun or corona discharge device prior to drawing and forwarding the filaments.

U.S. Pat. No. 4,208,366 describes a spunbonding process without the use of forced air attenuation, but which includes electrostatic treatment of the filament bundle. The extruded filaments pass through an electrostatic charging zone and are drawn through a nip between elastomer covered draw rolls. The charged filaments are propelled by the draw rolls into an electrostatic field generated between the rolls and the collecting surface, which attracts the filaments to the collecting surface.

U.S. Pat. Nos. 3,163,753, 3,341,394, and 4,009,508 relate to the use of corona electrodes for electrostatic treatment of filament bundles attenuated with round attenuator guns. In U.S. Pat. No. 3,163,753, the filament bundle is passed adjacent a charged corona electrode while passing over a grounded bar. In U.S. Pat. No. 3,341,394, a corona is applied while the filaments are under tension and before the filaments enter the attenuation tube. In U.S. Pat. No. 4,009,508, the filaments are subjected to electrostatic treatment from a corona after they have been discharged from the round attenuator tube and while the filaments impinge upon a target electrode for spreading in the electric field.

Various slot attenuators have been developed to overcome the problems and limitations of the round attenuator. In a slot attenuator, or slot draw process, the multiple tube attenuators are replaced with a single slot-shaped attenuator that covers the full width of the machine. A supply of air is admitted into the slot attenuator below the spinneret face. The air proceeds down the attenuator channel, which narrows in width, creating a venturi effect to accelerate the air flow and cause filament attenuation. The filaments exit the attenuator channel and are collected on the forming wire. The attenuation air, depending on the type of slot draw process used, can be directed into the attenuation slot by a pressurized air supply above the slot, or by a vacuum located below the forming wire. Slot drawing has various advantages over the Lurgi and other tube-shaped attenuator processes. The slot attenuator is self-threading in that the filaments fall out of the spin block directly into the slot attenuator. The high pressure air used by Lurgi devices is not always required, thereby reducing noise and utility costs.

However, despite the advantages of the slot draw process, cover problems can still occur, particularly for lighter weight fabrics. The forced air stream can introduce turbulence at the point where the web is formed on the collection surface, which adversely affects the quality of the web. Additionally, manufacturers are still attempting to produce webs at higher processing speeds, which compounds the problem. For example, U.S. Pat. No. 4,753,698 describes a technique for mechanically oscillating the rank of filaments exiting a slot draw attenuator and applying vacuum through the forming wire to fix the filaments in place. Coanda rolls set up a pendular movement in the filament rank. However, the swinging velocity of the filaments at the reversal points is zero, and, unless special precautions are taken, pile-ups can occur at the reversal points.

In view of the advantages of the slot draw process over prior filament attenuation techniques, it would be desirable to provide a slot-draw process capable of producing spunbonded fabrics having better cover properties. Accordingly, it is an object of the present invention to provide a slot draw process and apparatus for producing a spunbonded nonwoven web having improved cover properties. More particularly, it is an object of the present invention to provide a slot draw process and apparatus capable of producing nonwoven webs having excellent cover characteristics, despite low basis weight or high processing speeds.

SUMMARY OF THE INVENTION

In accordance with the invention, a slot draw attenuator is provided with a corona device positioned for electrostatically charging filaments leaving the attenuator so that electrostatic repelling forces are induced in the filaments to more uniformly spread the filaments before they are deposited on a collection surface to form a web.

The slot draw attenuator, more particularly, has opposing walls defining an entrance slot for receiving the filaments, an exit slot from which the filaments are expelled, and a slot-shaped passageway extending between the entrance and the exit and through which the filaments travel while being drawn and attenuated. A collection surface is positioned adjacent the exit slot of the attenuator for receiving the filaments that are expelled from the attenuator to form a web. The corona device includes an electrode means that is carried on the walls of the attenuator and is positioned for generating an electrostatically charged field across the slot-shaped passageway through which the filaments travel.

More specifically, the electrode means includes a series of point or wire corona electrodes that are carried by the exit slot on one of the opposing attenuator walls. These corona electrodes are located in a staggered relation to one another at spaced locations across the width of the wall of the attenuator. A ground is connected to the other opposing wall of the attenuator. The high voltage power source is connected to each of the corona electrodes for producing a corona discharge, i.e. an electrical discharge in the air surrounding the corona electrode. The power is supplied through an electrical conductor that is carried by an elongate insulator bar attached to the attenuator wall. Each of the corona electrodes is mounted along the elongate insulator bar and is electrically connected to the electrical conductor through a high voltage resistor.

The present invention also provides a method of producing a web of thermoplastic filaments in which the filaments are directed into and through an elongate slot-shaped passageway while being attenuated and drawn. The filaments are electrostatically charged in the passageway and are then expelled from the passageway while the repelling forces induced in the filaments by the electrostatic charge cause the filaments to repel one another, thus more uniformly spreading and distributing the filaments. The filaments are then deposited on a collection surface to form a web.

More specifically, the method includes passing the filaments through a corona zone wherein a high voltage is applied to a series of corona electrodes located along one of a pair of opposing walls in the slot-shaped passageway. The electrodes generate a corona in the slot-shaped passageway between the wall carrying the electrodes and extending to the grounded other wall.

The apparatus and method of the invention are capable of producing spunbonded webs of enhanced uniformity and quality as compared to prior practice. Additionally, by practice of this invention, it is possible to produce spunbonded nonwoven fabrics that have acceptable cover and tensile properties at basis weights significantly lower than produced by previous apparatus and methods.

BRIEF DESCRIPTION OF THE DRAWINGS

Some of the features and advantages of the invention have been stated, other advantages will become apparent as the description of the invention proceeds, taken in conjunction with the accompanying drawings, in which.

DESCRIPTION OF THE ILLUSTRATED EMBODIMENT

Figure 1:
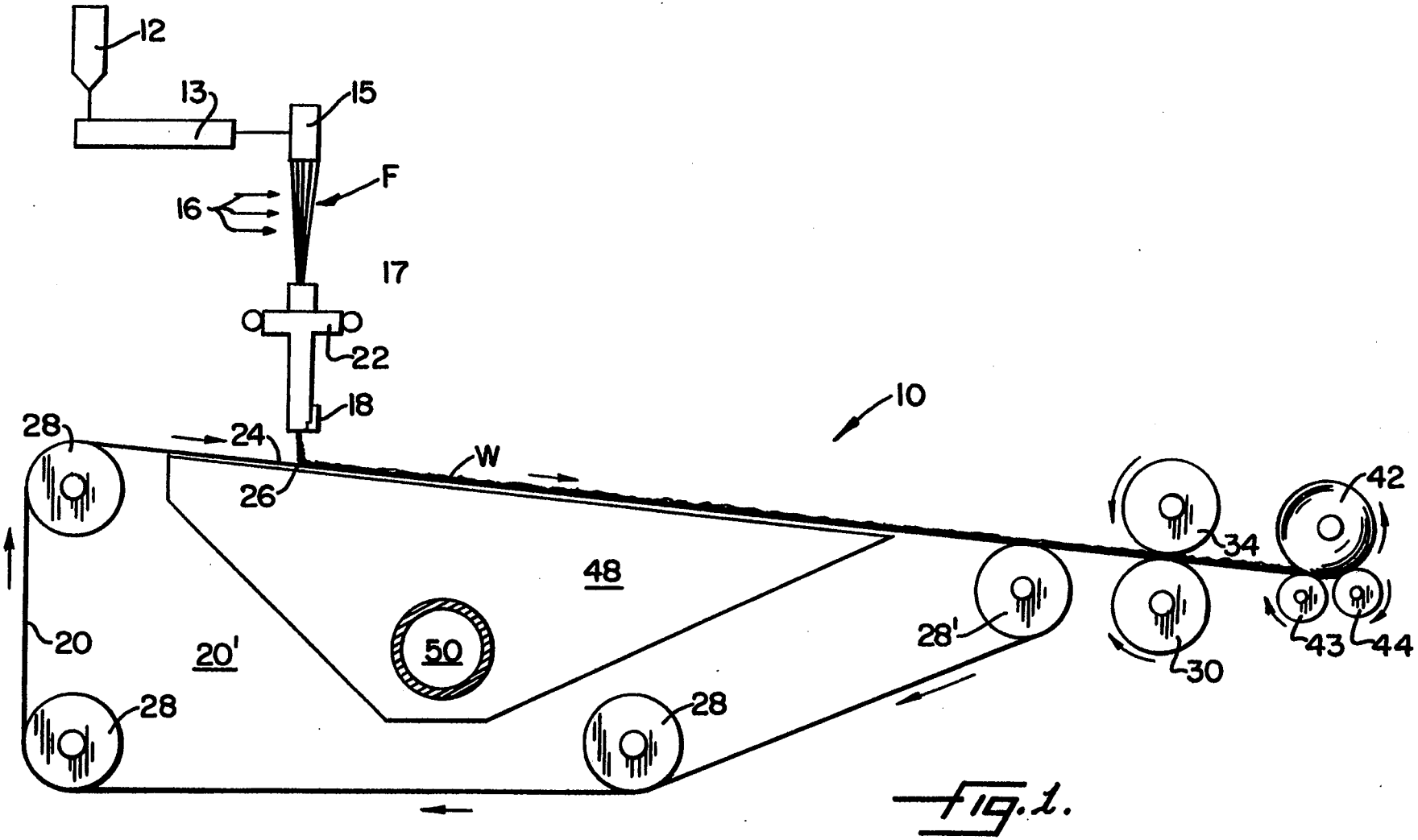
FIG. 1 schematically illustrates an apparatus for forming a spunbonded nonwoven web in accordance with the invention.

In FIG. 1, reference 10 generally indicates an apparatus for producing a spunbonded nonwoven web of continuous filaments. The apparatus 10 includes a melt spinning section for producing continuous filaments of a thermoplastic polymer, including a feed hopper 12 for receiving the polymer raw material in granular or pellet form and an extruder 13 for heating the polymer to a molten plastic state. The spunbonding process is applicable to a large variety of polymer resins, copolymers, and mixtures thereof, and the skilled artisan will recognize that the present invention is not restricted to the specific resins that may be used.

The molten polymer is directed from the extruder 13 at a controlled, metered rate to a generally linear die head or spinneret 15 where the molten polymer is extruded as streams from fine die orifices to form continuous filaments F. The filaments are quenched by a supply 16 of cooling air and are directed to a slot draw attenuation device 17 which covers the full width of the spunbonding machine. A supply of air is admitted into the slot attenuator 17 below the spinneret face. The air proceeds down the attenuator channel, which narrows in width in the direction away from the spinneret, creating a venturi effect, causing acceleration of the air and attenuation of filaments. The filaments exit the lower end of the attenuation device and are randomly deposited on an endless forming belt 20 to form a web W.

The attenuation air, depending on the type of slot draw process used, can be directed into the attenuation slot by a pressurized air supply above the slot, by a vacuum located below a forming belt, or by the use of eductors integrally formed in the slot. In the embodiment illustrated, the slot draw attenuator 17 includes an eductor 22 which introduces air into the attenuator 17 between the inlet and exit ends thereof.

A corona device, generally indicated by reference 18, is located adjacent the exit end of the attenuator. The corona device generates a corona of ionized air through which the filaments F pass as they travel through the attenuator, which introduces an electrostatic charge on the filaments, causing the filaments to repel one another. The filaments thus separate and spread apart from one another as they exit the attenuator before being deposited randomly on the endless forming belt 20. The corona device is described more fully below with reference to FIGS. 2 through 7.

Endless forming belt 20 forms a driven loop 20' that has a generally horizontally extending run 24 for supporting web W and for transporting the web from the initial lay-down point 26. Guide rolls 28 located inside loop 20' extend in substantially parallel relationship in the cross direction of the belt 20 for supporting the belt. Belt 20 is preferably of a porous or foraminous construction so that air from attenuator 17 can pass through the belt and so that vacuum can be applied to the web W through the belt to provide enhanced control over the web during formation and transfer.

As shown in FIG. 1, as the web W reaches the downstream end of the belt 20, it is transferred from the belt and is advanced through a calender nip 32 formed between cooperating rolls 30 and 34. The filaments of the web are thermally bonded together as they pass through the calender nip. Preferably, the one of the rolls has a smooth surface and cooperating roll is provided with a patterned surface so that thermal bonding takes place at discrete locations or points over the surface of the web.

After passing through nip 32, the now thermally bonded web is directed along the calender roll surface to a windup roll 42. Windup roll 42 may be of any conventional type. In the embodiment shown, support rolls 43 and 44 support and rotate the roll 42 of spunbonded nonwoven fabric.

Also shown in FIG. 1 is a vacuum box 48 inside the loop 20' that applies a vacuum through belt 20 for holding and immobilizing the web W with respect to the belt 20. Vacuum box 48 is a conventional sheet metal enclosure having a vacuum source connected thereto through conduit 50. Also the vacuum box 48 may be used to facilitate the attenuation of the filaments, as was explained above, by drawing air through the slot draw attenuator 17.

Figure 2:
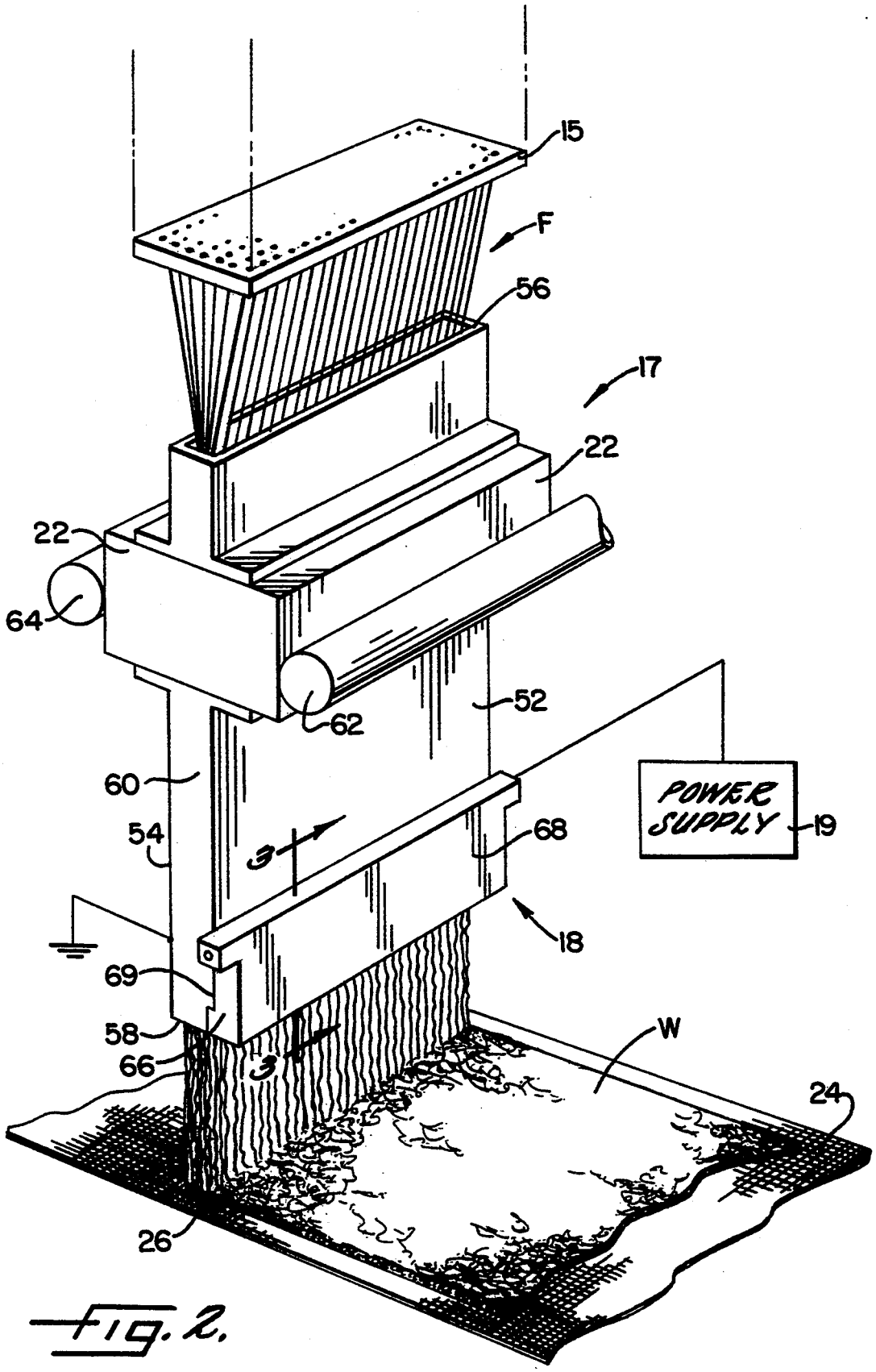
FIG. 2 is perspective view of a portion of the apparatus of FIG. 1 showing the slot draw attenuator.

The slot draw attenuator 17 will now be described in more detail in connection with FIG. 2. As shown, the attenuator has opposing walls 52 and 54 that define an entrance slot 56 for receiving the filaments F from spinneret 15 and an exit slot 58 from which the attenuated and drawn filaments are discharged. The opposing walls 52 and 54 also define an elongate slot-shaped passageway 60 (FIG. 3) that extends between the entrance 56 and the exit 58 and through which the filaments F travel while being drawn and attenuated. Eductors 22, associated with walls and 54, inject air into the slot shaped passageway 60 and along a downward flow path at a location just below the entrance slot 56. Air is distributed to the eductors through manifolds 62 and 64.

The corona device be is located adjacent the exit end 58 of the slot attenuator 17. As shown in FIG. 2, it includes a corona electrode assembly 66 that is carried by attenuator wall 52 and extends the full width of wall 52 in the cross direction. The electrode assembly 66 is connected to a high voltage power source 19 and the opposite attenuator wall 54 is grounded.

The electrode assembly 66 includes an elongate bar 68 formed of an electrical insulator with high dielectric strength, such as plastic. Insulator bar 68 is attached to the outer surface of attenuator wall 52. As can be seen more clearly in FIG. 3, the bottom edge of attenuator wall 52 terminates a short distance above the bottom edge of the opposing attenuator wall 54 and the insulator bar 68 has a projecting shoulder portion 69 extending from the body of the insulator bar 68 a distance corresponding to the thickness of the wall 52 so that the inner exposed face of the shoulder portion 69 lies coplanar with the inner surface of attenuator wall 52. The projecting shoulder portion 69 of the insulator bar 68 thus forms the bottom portion of the attenuator wall and is located directly opposite the opposing grounded attenuator wall 54. Shoulder portion 69 is shown enlarged in FIG. 6. Located in the projecting shoulder portion are cavities 70 in which are mounted a series of spaced apart point electrodes in the form of conductive metal pins 72 with ends which taper to sharpened points projecting into the passageway 60 a short distance. The pins 72 are oriented toward the opposing grounded attenuator wall 54 for creating a corona of ionized air across the entire passageway 60 adjacent the discharge end 58 of the attenuator slot.

Figures 3, 4, 5, 6, 7:
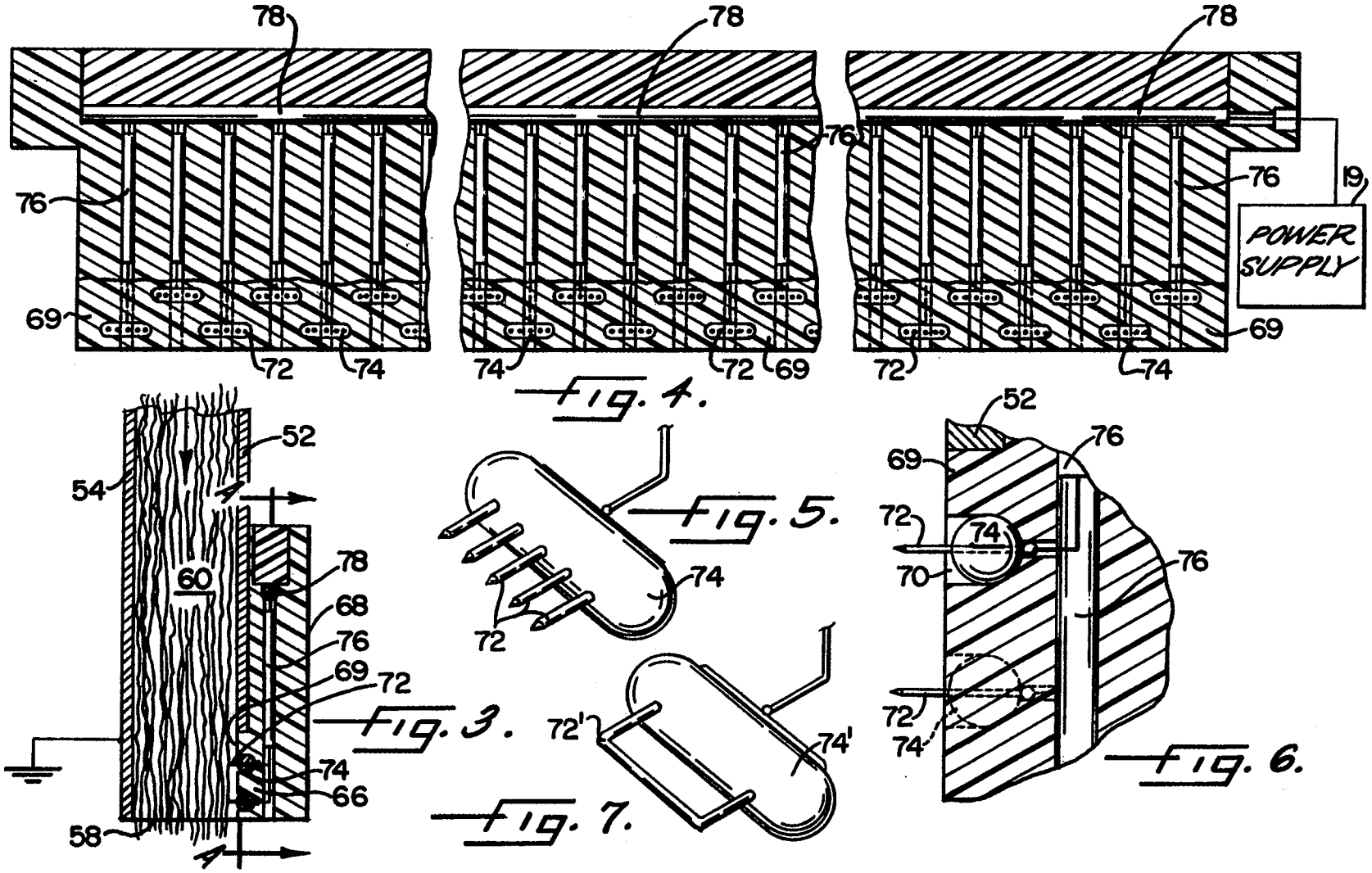
FIG. 3 is a transverse section through the slot draw attenuator, taken along line 2—2 of FIG. 2 and showing the corona electrode assembly used for electrostatically charging the filaments.
FIG. 4 is a longitudinal section through the corona electrode assembly taken along line 4—4 of FIG. 3.
FIG. 5 is a perspective view of a portion showing a group of pin-shaped point electrodes mounted in a mounting block for insertion into the corona electrode assembly.
FIG. 6 is an enlarged fragmentary cross-sectional view of the corona electrode assembly taken from FIG. 3 showing the attachment of the electrodes to high voltage resistors.
FIG. 7 is a perspective view similar to FIG. 5, showing an alternate form of corona electrode assembly.

Referring now to FIG. 4, it will be seen that the pins 72 are arranged in groups extending from a mounting block 74 formed of an electrically insulating material with high dielectric strength. A single mounting block and associated corona electrode pins are shown in enlarged perspective in FIG. 5. The mounting blocks are seated on the floor of the cavity 70 and are arranged in two vertically spaced apart rows extending the full width of the insulator bar. The mounting blocks in each row are spaced apart from one another and the mounting blocks in one row are arranged in offset or staggered relation to the mounting blocks in the other row so as to insure that the electrically charged corona field produced by the corona electrodes is uniform and covers the full width of the passageway 60 from left to right as seen in FIG. 4.

The respective pins of each mounting block 74 are connected to high voltage power source 19 through a resistor 76. The resistors are located in vertical bores formed in the insulator bar 68. The lower end of each resistor is electrically connected to the respective pins 72 of a mounting block 74 through a central lead and the upper end of the resistor is connected to an electrical conductor or buss 78 which extends the full width of the insulator bar 68 to distribute a high voltage from power source 19.

Any high voltage DC source 19 may be used to establish the electrostatic field between the corona electrodes and grounded opposing slot wall 54. The source should preferably have variable voltage settings up to at least about 50 kV and, preferably, (−) and (+) polarity settings to permit adjustments in establishing the electrostatic field.

When the filaments pass through the corona, they become electrostatically charged, which causes the filaments to repel one another and to separate and to spread apart as they enter the free fall zone located between the attenuator 17 and the forming belt 20 and continue to do so until deposited on the forming belt. The free fall zone should be of sufficient length to provide for the desired filament separation in the web.

FIG. 7 shows an alternative form of the corona electrode wherein the electrodes are in the form of a wire rather than individual pins. Thus, as shown in FIG. 7, the mounting block 74' has a corona electrode in the form of a wire 72' extending the length of the mounting block.

EXAMPLE

This example compares the physical properties of spunbonded webs of various basis weights produced in accordance with the present invention using a corona device with webs of comparable basis weight produced by similar processing conditions but without the corona device.

The results tabulated below were achieved under the following process conditions. A polypropylene polymer was melt extruded and drawn by a slot draw attenuator at a filament speed of approximately 1000 to 3000 meters per minute. The distance between the corona device and the forming wire was 350–600 mm. The distance between the tip of the pins and the opposite grounded conductive plate was 11 mm and a voltage of from 8 to 30 kV was applied from a high voltage source to the pins. Additionally, a vacuum was applied to the forming wire of from 8 to 180 mm of water and the forming wire traveled at approximately 50 to 200 meters per minute. Samples 1, 3 and 5 were produced with the corona device operating and are thus in accordance with the invention. Samples 2, 4 and 6 are control samples produced on the same apparatus under similar processing conditions, but with the corona device inoperative. Results achieved under these conditions are tabulated below.

TABLE OF PHYSICAL PROPERTIES

| | SAMPLE NUMBER | | | | | |
|---|---|---|---|---|---|---|
| | 1 | 2 | 3 | 4 | 5 | 6 |
| | DESCRIPTION | | | | | |
| | 13.56 GSM CORONA | 13.56 GSM NON-CORONA | 18.64 GSM CORONA | 18.64 GSM NON-CORONA | 22 GSM CORONA | 22 GSM NON-CORONA |
| BASIS WEIGHT | | | | | | |
| -gsm | 14.42 | 13.85 | 20.45 | 17.54 | 21.91 | 23.36 |
| -osy | 0.43 | 0.41 | 0.60 | 0.52 | 0.65 | 0.69 |
| CALIPER (mils) | 6.2 (0.7) | 6.3 (0.8) | 8.2 (0.5) | 8.0 (1.1) | 8.4 (0.8) | 9.6 (0.7) |
| DECITEX (dtex) | 1.78 (0.38) | 1.80 (0.22) | 1.95 (0.31) | 1.90 (0.27) | 1.99 (0.35) | 1.81 (0.42) |
| DENIER (dpf) | 1.60 (0.34) | 1.62 (0.20) | 1.75 (0.28) | 1.71 (0.24) | 1.79 (0.31) | 1.63 (0.38) |
| TENSILES (g/in)* | | | | | | |
| -CD | 560 (94) | 377 (133) | 719 (156) | 795 (302) | 904 (387) | 1082 (252) |
| -MD | 1587 (157) | 819 (226) | 2003 (349) | 1311 (247) | 2923 (595) | 1458 (321) |
| MD/CD RATIO | 2.83:1 | 2.17:1 | 2.79:1 | 1.65:1 | 3.23:1 | 1.35:1 |
| PEAK ELONG. (%) | | | | | | |
| -CD | 44 (13) | 35 (9) | 46 (12) | 35 (11) | 47 (18) | 38 (7) |
| -MD | 33 (6) | 23 (5) | 34 (11) | 29 (6) | 50 (13) | 31 (5) |
| BREAK ELONG. (%) | | | | | | |
| -CD | 49 (12) | 37 (10) | 50 (11) | 40 (11) | 51 (18) | 44 (10) |
| -MD | 35 (6) | 27 (5) | 37 (9) | 33 (9) | 51 (13) | 33 (6) |
| TEA (in.g./in2) | | | | | | |
| -CD | 173 (70) | 87 (52) | 231 (93) | 206 (119) | 326 (220) | 305 (115) |
| -MD | 383 (116) | 144 (60) | 510 (215) | 297 (136) | 1062 (450) | 314 (102) |
| TRAPEZOID TEAR (lbs) | | | | | | |
| -CD | 1.99 (0.71) | 2.39 (0.92) | 3.59 (0.98) | 3.21 (1.03) | 3.98 (0.62) | 3.82 (0.89) |
| -MD | 4.20 (1.20) | 2.74 (0.98) | 4.51 (0.84) | 5.17 (1.62) | 4.89 (2.37) | 4.89 (2.37) |
| % BREAKTHROUGH | 8.0 (1.6) | 12.3 (2.3) | 2.2 (0.7) | 5.5 (2.1) | 1.6 (0.2) | 3.2 (1.2) |
| FORMATION (psu) | 3.58 (0.68) | 1.18 (0.93) | 4.31 (0.49) | 1.96 (0.76) | 4.51 (0.64) | 2.75 (0.76) |

( ) = Standard Deviation
*5" gauge length and 5"/min. crosshead speed.

As can be seen from the comparative examples, the fabrics produced by practice of the present invention have drastically improved physical properties as compared to the control sample of comparable basis weight. The tensile strength, both in the machine direction and in the cross direction, is significantly increased. Additionally, the percentage breakthrough is greatly reduced. The percentage breakthrough is a measurement of the level of penetration of certain size particles during a given time. The lower the percentage breakthrough, the better the quality and cover properties of the web. As also seen from the table, the degree of formation greatly improves with electrostatic application. Formation is the visual appearance of the web, indicating how uniformly the filaments are distributed throughout the entire web. This evaluation also takes into consideration such defects as streaks, splotches, light spots or even holes, and the presence of ropiness. Formation is evaluated by trained individuals visually on a scale of 0 to 5, with 5 being the best.

It should be understood that the specific embodiments described in detail hereinabove and illustrated in the drawings are specific examples of how the present invention may be practiced and that the invention is not limited to these specific embodiments. Those modifications that come within the meaning and range of equivalence of the claims are to be included within the scope of the invention.

What is claimed is:

1. An apparatus for producing a web of thermoplastic filaments comprising:

a) a slot draw attenuator having opposing side walls and opposing end walls defining an elongate entrance slot for receiving filaments, an elongate exit slot from which the filaments are expelled, and a slot-shaped passageway extending between said entrance and said exit and through which the filaments travel while being drawn and attenuated;

b) means cooperating with said attenuator for introducing a flow of air through the slot-shaped passageway sufficient for drawing, stretching and attenuating the filaments passing through the slot-shaped passageway;

c) a collection surface positioned adjacent said exit slot of said attenuator for receiving the filaments that are expelled from said attenuator to form a filamentary web; and d) corona means cooperating with said attenuator and positioned for electrostatically charging the filaments so that repelling forces are induced in the filaments to more uniformly spread the filaments before they are deposited on said collection surface to form a web.

2. The apparatus according to claim 1 wherein said corona means includes electrode means carried on said walls of said attenuator and positioned for generating an electrostatic field through which the filaments pass as they travel through said slot-shaped passageway of said attenuator.

3. The apparatus according to claim 2 wherein said electrode means includes a series of corona electrodes carried by one of said opposing attenuator walls, said corona electrodes being located at spaced locations along the length of the slot-shaped passageway, a ground connected to the other of said opposing attenuator walls, and a high voltage power source connected to each of said corona electrodes.

4. The apparatus according to claim 3 wherein said electrode means includes an elongate insulator bar carried by said one attenuator wall adjacent said exit slot, and an electrically conductive buss carried by said insulator bar, and wherein said corona electrodes are mounted at spaced locations along said elongate insulator bar and are electrically connected to said conductive buss.

5. The apparatus according to claim 4 wherein said corona electrodes each comprise a pin having a sharpened point facing into the slot-shaped passageway and a high voltage resistor electrically connecting the pin to said buss.

6. The apparatus according to claim 4 wherein said corona electrodes each comprise a wire facing into the slot-shaped passageway and a high voltage resistor electrically connecting the wire to said buss.

7. The apparatus according to claim 3 wherein said corona electrodes are located in staggered relation to one another at spaced locations across the width of said one wall.

8. An apparatus for producing a web of spunbonded thermoplastic filaments comprising:

a) means for extruding filaments of a thermoplastic polymer;

b) a slot draw attenuator having opposing side walls and opposing end walls defining an elongate entrance slot positioned for receiving extruded filaments from said extruding means, an elongate exit slot from which the filaments are expelled, a slot-shaped passageway extending between said entrance and said exit and through which the filaments travel, and means cooperating with said opposing walls for introducing a flow of air through the slot-shaped passageway sufficient for drawing, stretching and attenuating the filaments passing through said slot-shaped passageway;

c) an endless moving belt positioned for receiving the filaments expelled from said attenuator and for forming a filamentary web;

d) a corona device for electrostatically charging the filaments that are expelled from said attenuator, said corona device comprising a plurality of corona electrodes fixed to one of said walls of said attenuator adjacent said exit slot, a ground connected to the wall of said attenuator opposite said corona electrodes, and a high voltage power source connected to said corona electrodes so as to form an electrostatic field through which the filaments travel so that the filaments become charged and electrostatic repelling forces are induced in the filaments to more uniformly spread the filaments before they are deposited on said belt to form a web; and e) means for bonding the filaments together after they have been formed into a web on said belt.

9. The apparatus according to claim 8 wherein said corona device includes an elongate insulator bar carried by said one attenuator wall adjacent said exit end, and an electrically conductive buss carried by said insulator bar and electrically connecting said corona electrodes to said high voltage source, and wherein said corona electrodes are mounted at spaced locations along said elongate insulator bar.

10. The apparatus according to claim 9 wherein said corona electrodes each comprise a pin having a sharpened point facing into the slot-shaped passageway and a high voltage resistor electrically connecting said pins to said buss.

11. The apparatus of claim 10 said apparatus includes mounting blocks fixed to said resistors for electrically connecting said pins to said resistors.

12. The apparatus according to claim 8 wherein said corona electrodes are located in staggered relation to one another at spaced locations across the width of said one wall.

13. An apparatus for producing a web of spunbonded thermoplastic filaments comprising:

a) a spinning beam for extruding filaments of a thermoplastic polymer;

b) a slot draw attenuator having opposing side walls and opposing end walls defining an elongate entrance slot positioned for receiving extruded filaments from said spinning beam, an elongate exit slot from which the filaments are expelled, and a slot-shaped passageway extending between said entrance and said exit and through which the filaments travel while being drawn and attenuated, said slot draw attenuator including an adductor for inducing a flow of air through said slot draw attenuator for drawing, stretching and attenuating the filaments;

c) an endless moving belt positioned for receiving the filaments expelled from said attenuator and for forming a filamentary web;

d) a corona device for electrostatically charging the filaments that are expelled from said attenuator, said corona device comprising an elongate insulator bar carried by one of said opposing attenuator walls adjacent said exit slot, an electrically conductive buss carried by said insulator bar, a plurality of corona electrodes mounted at spaced locations along said elongate insulator bar and electrically connected to said conductive buss, a ground connected to the wall of said attenuator opposite said corona electrodes, and a high voltage power source connected to said corona electrodes through said conductive buss so as to form an electrostatic field through which the filaments travel so that the filaments become charged and electrostatic repelling forces are induced in the filaments to more uniformly spread the filaments before they are deposited on said belt to form a web;

e) a calendar nip for bonding the filaments together after they have been formed into a web on said belt; and f) a windup roll for winding the spunbonded web after passage through said calendar nip.

14. The apparatus according to claim 13 wherein said corona electrodes each comprise a pin having a sharpened point facing into the slot-shaped passageway and a high voltage resistor electrically connecting said pins to said buss.

15. The apparatus according to claim 14 wherein said apparatus includes mounting blocks fixed to said resistors for electrically connecting said pins to said resistors.

16. The apparatus according to claim 13 wherein said corona electrodes are located in staggered relation to one another at said spaced locations along said elongate insulator bar.

17. A method for producing a web of thermoplastic filaments comprising forming a plurality of filaments, directing the filaments into and through an elongate slot-shaped passageway while attenuating, stretching and drawing the filaments as they travel through the passageway, electrostatically charging the filaments as they travel through the slot-shaped passageway, expelling the electrostatically charged filaments from the elongate slot-shaped passageway while permitting the repelling forces induced in the filaments by the electrostatic charge to more uniformly spread the filaments, and depositing the thus spread filaments on a collection surface to form a web.

18. The method according to claim 17 wherein the step of electrostatically charging the filaments comprises passing the filaments through an electrostatic field formed by a corona.

19. The method according to claim 18 wherein the step of passing the filaments through an electrostatic field includes applying a high voltage to an electrode located along one of a pair of opposing walls in the slot-shaped passageway and generating a corona in the slot-shaped passageway between the electrode and the opposing wall of the slot-shaped passageway.

20. The method according to claim 19 wherein the step of applying a high voltage to an electrode comprises distributing the high voltage among a series of corona electrodes extending into the slot-shaped passageway at spaced locations along one wall of the passageway.

21. A method for producing a web of spunbonded thermoplastic filaments comprising the steps of:

a) forming a plurality of filaments of fiber-forming thermoplastic polymer and directing the filaments into and through an attenuator passageway in the form of an elongate slot-shaped venturi while causing air to flow through the slot-shaped venturi so as to entrain the filaments and attenuate, stretch and draw them as they travel through the attenuator passageway;

b) generating a corona of ionized air in the attenuator passageway adjacent the exit end thereof and in the path of the advancing filaments so that the filaments become electrostatically charged;

c) expelling the electrostatically charged filaments from the attenuator passageway and permitting the filaments to fall onto an underlying collection surface while repelling forces induced in the electrostatically charged filaments cause separation and spreading of the filaments;

e) advancing the collection surface as the filaments are deposited thereon to form a web; and f) thermally bonding the filaments to form a unitary web.

22. The apparatus according to claim 1 further comprising means for introducing the thermoplastic polymer filaments into said attenuator along substantially the entire longitudinal extent of said elongate entrance slot.

23. The apparatus according to claim 1 wherein said corona means cooperates with said attenuator substantially along the entire longitudinal extent of said elongate exit slot.

24. The apparatus according to claim 8 wherein said means for drawing and attenuating the filaments comprises means associated with said attenuator for introducing a flow of air through said slot-shaped passageway and for drawing and attenuating the filaments passing through the slot-shaped passageway.

* * * * *

UNITED STATES PATENT AND TRADEMARK OFFICE

CERTIFICATE OF CORRECTION

PATENT NO. : 5,397,413

DATED : March 14, 1995

INVENTOR(S) : Trimble et al.

It is certified that error appears in the above-identified patent and that said Letters Patent is hereby corrected as shown below:

Column 6, line 16, after "walls", insert -- 52 --.

Column 6, line 20, "be" should be -- 18 --.

Columns 7-8, bottom line of chart, "4.31" should be -- 4.35 --.

Signed and Sealed this

Thirteenth Day of June, 1995

*Attest:*

*Attesting Officer*

BRUCE LEHMAN

*Commissioner of Patents and Trademarks*